US007090546B2

(12) United States Patent
Zheng et al.

(10) Patent No.: US 7,090,546 B2
(45) Date of Patent: Aug. 15, 2006

(54) CARD CONNECTOR

(75) Inventors: Qisheng Zheng, Kunsan (CN); ChenHua Liang, Kunsan (CN); Bo Chen, KUnsan (CN)

(73) Assignee: Hon Hai Precision Ind. Co., LTD, Taipei Hsien (TW)

( * ) Notice: Subject to any disclaimer, the term of this patent is extended or adjusted under 35 U.S.C. 154(b) by 0 days.

(21) Appl. No.: 11/001,873

(22) Filed: Dec. 1, 2004

(65) Prior Publication Data

US 2005/0130499 A1 Jun. 16, 2005

(30) Foreign Application Priority Data

Dec. 16, 2003 (JP) ..... 2003201233909

(51) Int. Cl.
*H01R 4/48* (2006.01)

(52) U.S. Cl. ..... 439/862

(58) Field of Classification Search ..... 439/862, 439/630

See application file for complete search history.

(56) References Cited

U.S. PATENT DOCUMENTS 5,975,959 A * 11/1999 Joly ..... 439/630
6,000,969 A 12/1999 Reichardt et al.
6,604,950 B1 * 8/2003 Maldonado et al. ..... 439/66

* cited by examiner

*Primary Examiner*—Javaid H. Nasri
(74) *Attorney, Agent, or Firm*—Wei Te Chung

(57) ABSTRACT

An electrical card connector (100) for electrically connecting an electrical card with a printed circuit board includes an insulative housing (10) with a plurality of passageways (101) and a plurality of terminals (20) received in the passageways. Each terminal includes a main body (201), a contacting portion (203) for electrically contacting with the card, a soldering portion (204) for soldering the electrical card connector to the printed circuit board. The main body includes a pair of parallel girders (2011) and a pair of fixing portions (2012) perpendicularly and downwardly extend from opposite ends of the pair of girders. The insulative housing defines a plurality of recesses (1012) for receiving corresponding fixing portions of the terminals.

2 Claims, 4 Drawing Sheets

CARD CONNECTOR

BACKGROUND OF THE INVENTION

1. Field of the Invention

This invention generally relates to an electrical connector and more particularly, to an electrical card connector for a portable electronic appliance.

2. Description of the Prior Art

Conventional electrical card connector used in a portable electronic device for connecting an electrical card to a printed circuit board generally includes an insulative housing, a plurality of electrodes or contacts exposed in the housing for electrically connecting with circuit traces of the card and a card-protecting shell permitting the card to insert therein and remove therefrom and preventing the card from any exterior hazards. U.S. Pat. No. 6,000,969 discloses a card connector including an insulative housing and a plurality of contacts received in the housing. The insulative housing includes a plurality of passageways for receiving the contacts. Each contact has a loop-shaped connection end and a guide portion. A downwardly bent tongue is punched out of a middle of the guide portion. The insulative housing has a plurality of beveled surfaces at a bottom surface thereof, for engaging with corresponding loop-shaped connection ends of the contacts, therefore the bend of the connection end securely fixes the insulative housing. At the same time, the tongue abuts against the insulative housing. Each contact includes a contacting portion projecting beyond a top surface of the housing for contacting with the electrical card. However, the contacts are fixed in the passageways only through the loop-shaped connection ends of the contacts engaging with the beveled surfaces of the insulative housing. Because the contacts frequently electrically engage with the card, the guide portions of the contacts are easily movable relative to the housing, thereby influencing the quality of transmission.

Hence, an improved card connector is desired to overcome the foregoing shortcomings.

BRIEF SUMMARY OF THE INVENTION

It is an object of the present invention to provide a card connector which can securely fix terminals therein.

In order to attain the object above, an electrical card connector for electrically connecting an electrical card with a printed circuit board includes an insulative housing with a plurality of passageways and a plurality of terminals received in the passageways. Each terminal includes a main body, a contacting portion for electrically contacting with the card, a soldering portion for soldering the electrical card connector to the printed circuit board. The main body includes a pair of parallel girders and a pair of fixing portions perpendicularly and downwardly from opposite ends of the pair of girders. The insulative housing defines a plurality of recesses for receiving corresponding fixing portions of the terminals.

Other objects, advantages and novel features of the invention will become more apparent from the following detailed description of the present embodiment when taken in conjunction with the accompanying drawings.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

DETAILED DESCRIPTION OF THE INVENTION

Figure 1:
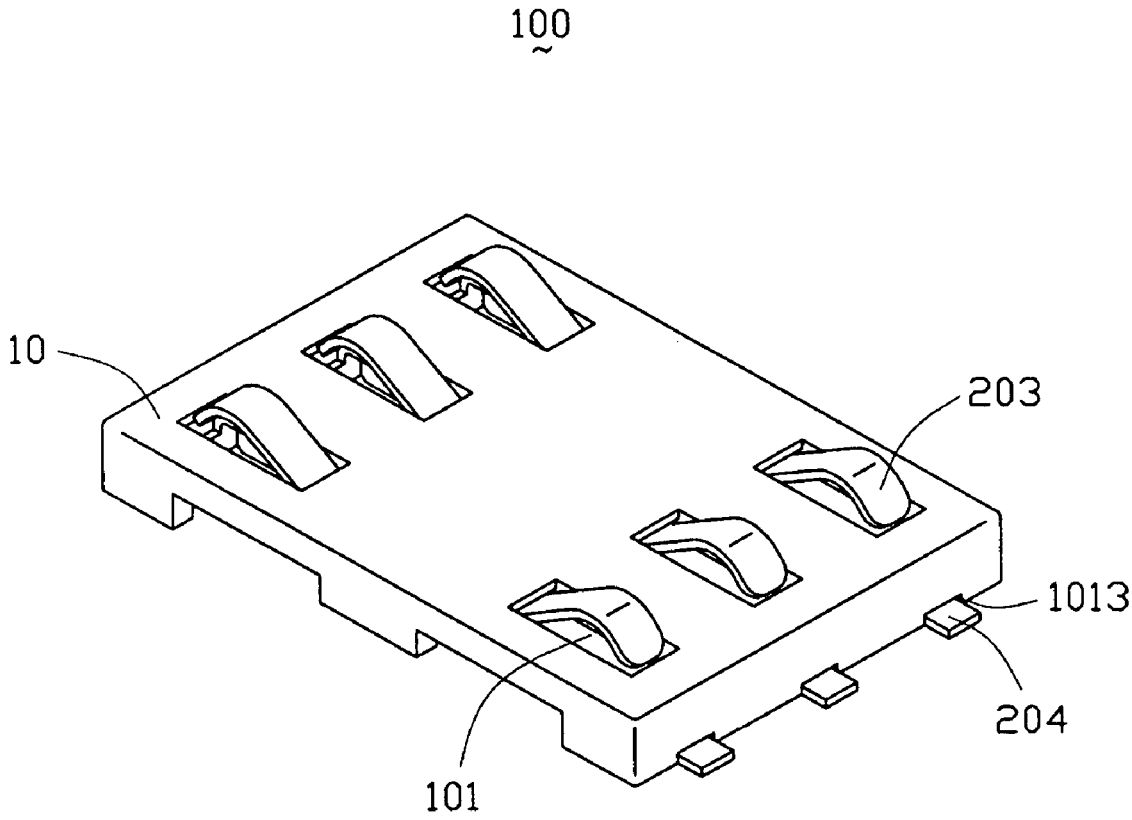
FIG. 1 is a perspective view of an electrical card connector according to the present invention.
Figure 2:
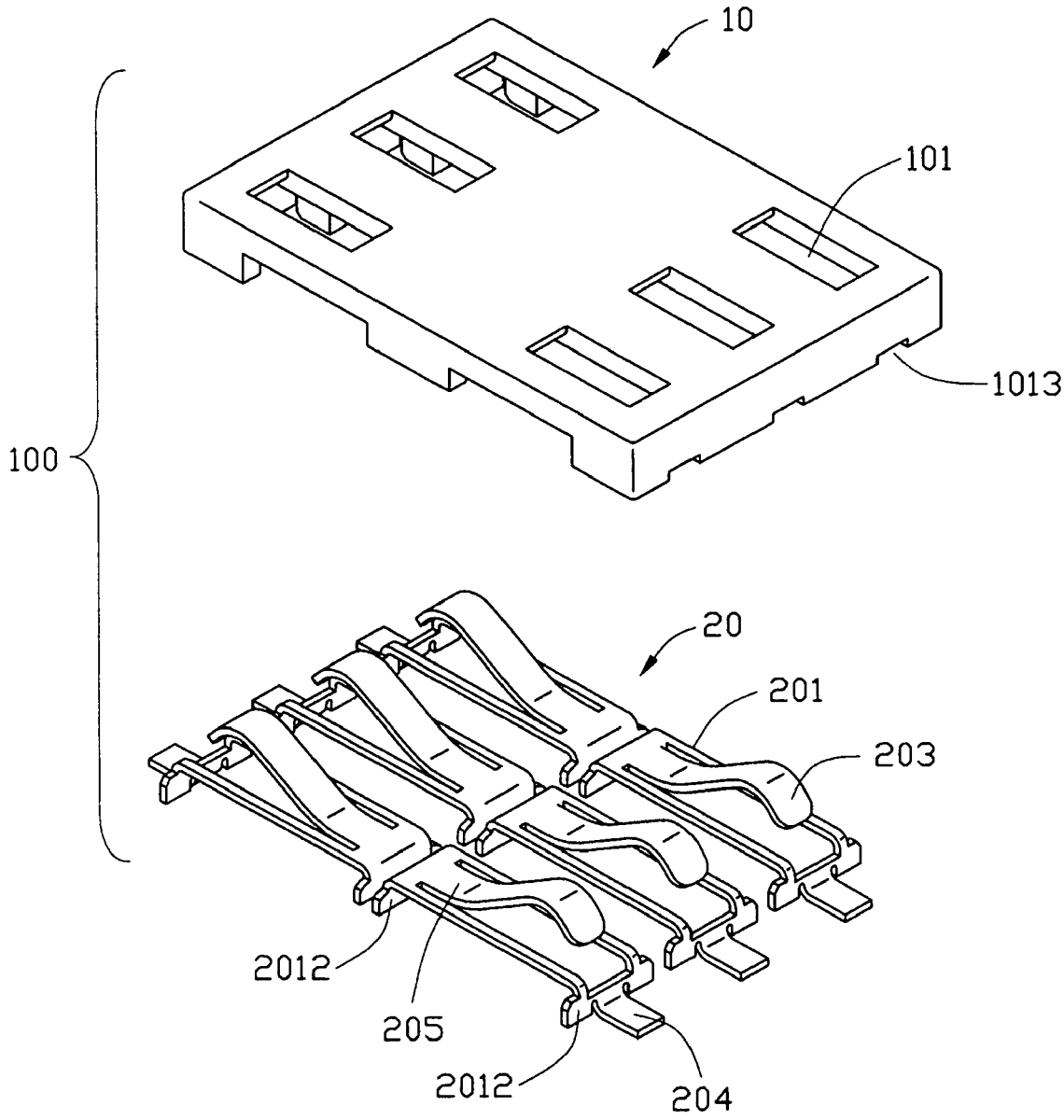
FIG. 2 is an exploded view of the electrical card connector of FIG. 1.

Referring to FIGS. 1–2, an electrical card connector 100 according to the present invention is provided for electrically connecting a card (not shown) with a printed circuit board (not shown) and includes a substantially rectangular insulative housing 10 and a plurality of terminals 20 fixed in the housing 10.

Referring to FIGS. 1–4, the insulative housing 10 includes two sets of longitudinal passageways 101 through the top and bottom walls (not labeled) thereof extending toward a middle of the housing 10. Each passageway 101 includes an inclined plane 102 longitudinally and slantways extending from an end of an inner surface thereof. Each passageway 101 includes a substantially L-shaped step portion 1011 positioned in lateral opposite sides of a bottom portion thereof. A pair of recesses 1012 are defined in opposite sides of each passageway 101 and communicate with the step portion 1011. A notch 1013 is longitudinally defined in an outside of the passageway 101 and communicates with the recesses 1012.

Figure 3:
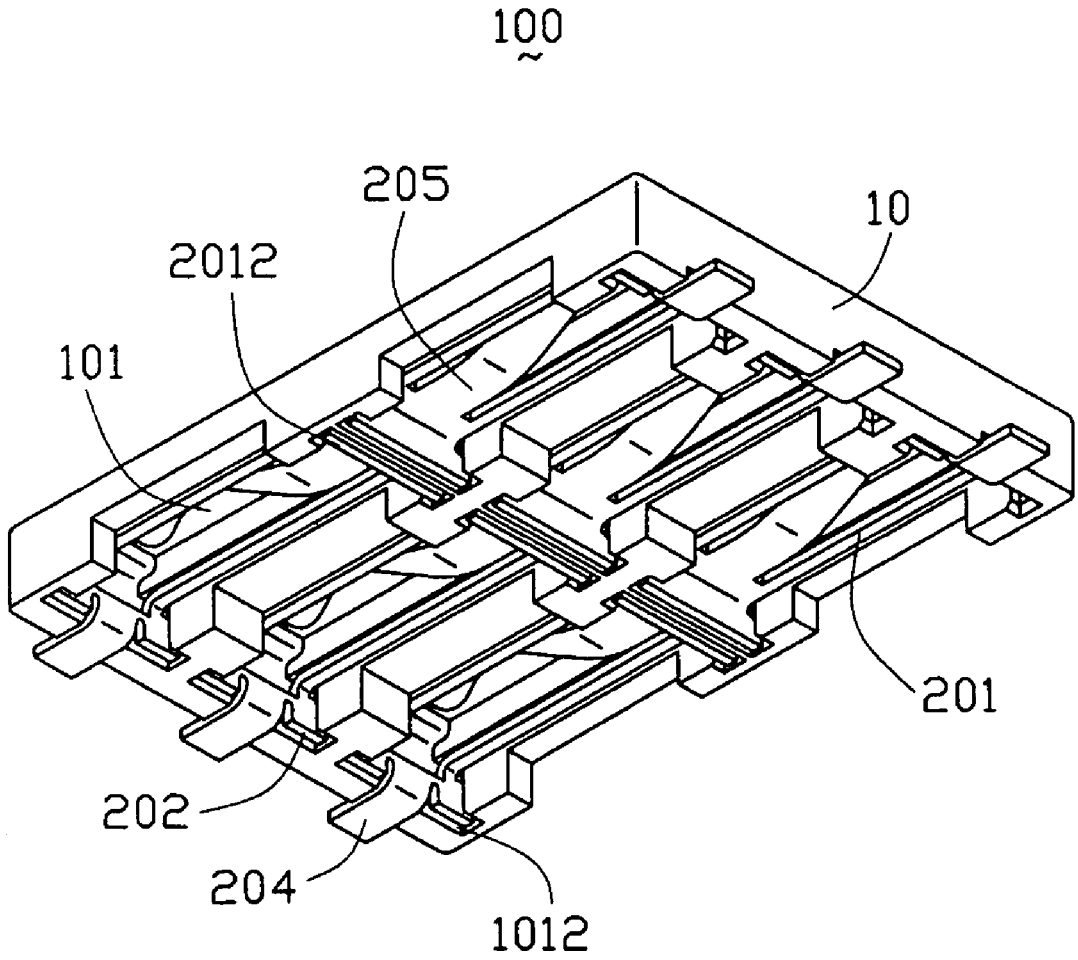
FIG. 3 is a perspective view similar to FIG. 1 but taken from another perspective.
Figure 4:
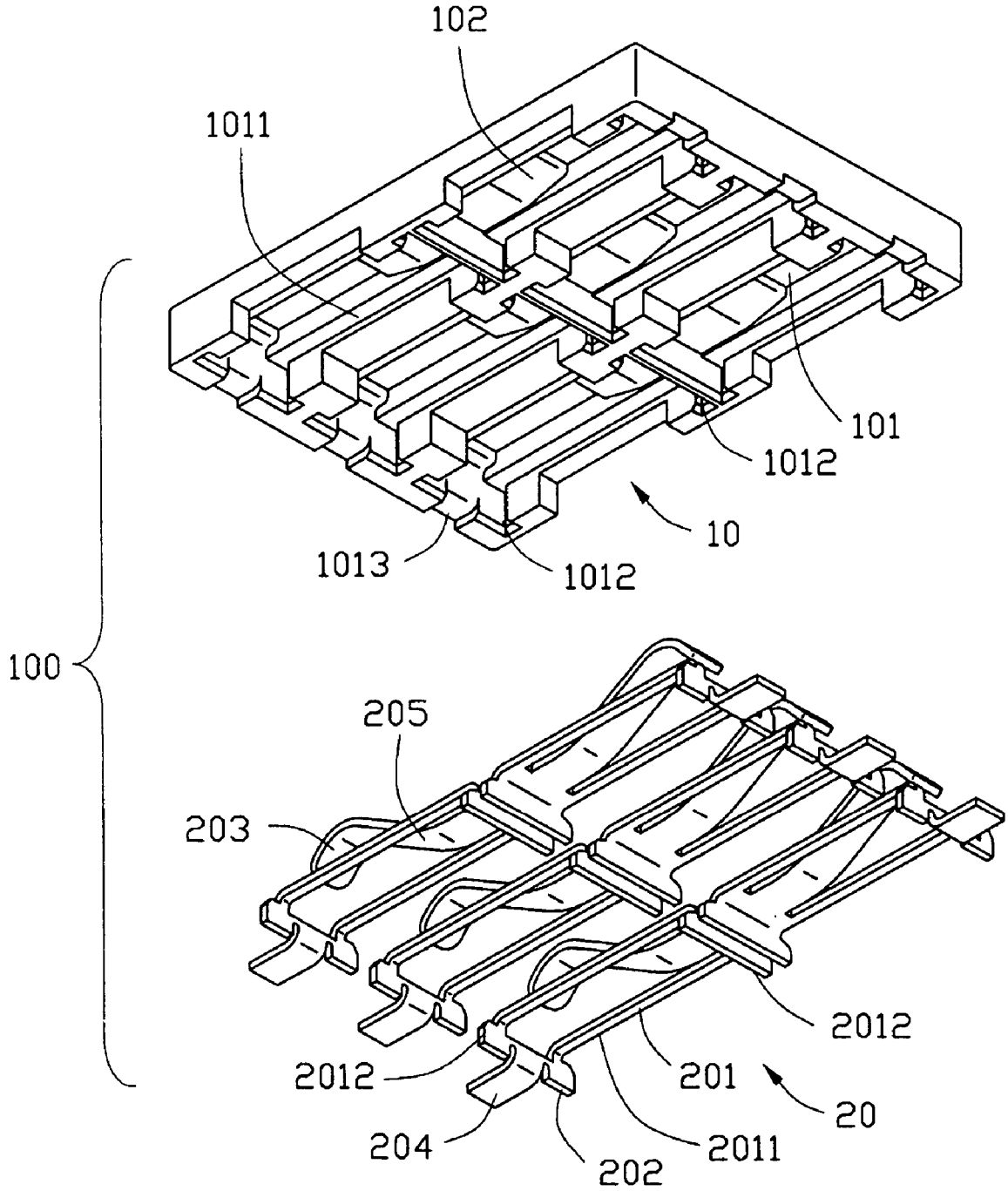
FIG. 4 is an exploded view of FIG. 3.

Referring to FIGS. 2–4, each terminal 20 is stamped from a sheet metal and is retained in a corresponding passageway 101 and includes a main body 201 for engaging with the step portion 1011 and the recesses 1012. The main body 201 is a substantially rectangular frame and consists a pair of parallel girders 2011 and a pair of fixing portions 2012 downwardly and perpendicularly projecting from opposite ends of the pair of girders 2011. A stamped contacting portion 203 upwardly extends from a free end of the main body 201 for contacting with the card. A soldering portion 204 outwardly extends from a generally middle portion of one fixing portion 2012 and is received in the notch 1013 of the housing 10 for soldering the electrical connector 100 to the printed circuit board. Each terminal 20 further includes a spring portion 205 for interconnecting the main body 201 and the contacting portion 203.

Referring to FIGS. 1–4, in assembly, each terminal 20 is assembled in a corresponding passageway 101 from a bottom surface of the insulative housing 10. The main body 201 of each terminal 20 engages with the step portion 1011 of the passageway 101. The fixing portions 2012 latch into the recesses 1012 of the passageway 101, thereby securely retained the terminal 20 in the passageway 101. The spring portion 205 of the terminal 20 abuts against the inclined plane 102 of the housing 10. The contacting portion 203 of the terminal 20 projects beyond the top surface of the housing 10 and contacts with the card. At the same time, the soldering portion 204 extends beyond the notch 1013 of the housing 10 and solders the electrical connector 100 to the printed circuit board.

Comparing to prior art, the electrical connector 100 according to the present invention adopts two vertical fixing portions 1012 respectively formed on opposite sides of the main body 201 for latching into the recesses 1012 of the housing 10. As a result, each terminal 20 is securely fixed in the housing 10. In process of use and assemble, the terminals 20 are securely held in the housing 10 and are capable of reliably engaging with the card, thereby prolonging the life-span of the terminals 20.

It is to be understood, however, that even though numerous, characteristics and advantages of the present invention have been set fourth in the foregoing description, together with details of the structure and function of the invention, the disclosed is illustrative only, and changes may be made in detail, especially in matters of number, shape, size, and arrangement of parts within the principles of the invention to the full extent indicated by the broad general meaning of the terms in which the appended claims are expressed.

What is claimed is:

1. A card connector adapted for connecting an electrical card with a printed circuit board comprising:

an insulative housing comprising a plurality of passageways and a plurality of pairs of recesses communicating with corresponding passageways; and a plurality of terminals each comprising a main body retained in said passageway, a contacting portion for electrically contacting with the card and a soldering portion for soldering the card connector to the printed circuit board, the main body comprising a pair of fixing portions perpendicularly extending from opposite ends thereof and latching into a corresponding pair of recesses of the housing, wherein said contacting portion extends from one fixing portion toward the other; wherein said main body comprises a pair of horizontal girders parallel to each other, the fixing portions perpendicularly extending between the girders; wherein said main body comprises said pair of girders parallel to each other, said contacting portion extending between said pair of girders; wherein said soldering portion horizontally extends from a bottom end of the fixing portion; wherein each passageway is longitudinal and includes a pair of step portions positioned on opposite sides thereof for receiving the girders of a corresponding terminal; wherein said housing includes a notch for receiving the soldering portion of the terminal; wherein said insulative housing includes an inclined plane projecting into the passageway, and wherein said contacting portion includes a spring portion abutting against the inclined plane.

2. A card connector comprising:

an insulative housing defining opposite upper and bottom faces with a plurality of passageways extending therethrough in a vertical direction;

a pair of recesses communicatively located by two sides of each of said passageways;

a plurality of terminals disposed in the corresponding passageways, respectively, each of said terminals including a main body having a pair of spaced horizontal beams with a contacting portion located therebetween and extending upwardly above the upper face, a pair of fixing portions located at two opposite ends of each of said horizontal beams and received in the corresponding recesses, respectively; wherein each of said terminals further includes a mounting portion for mounting to a printed circuit board, and said mounting portion extends from one of said fixing portions; wherein said one of the fixing portions is positioned adjacent to a side face of the housing; wherein each of said recesses is exposed to the bottom face while unexposed to the upper face.

* * * * *